United States Patent [19]

Lawless

[11] 4,296,147

[45] Oct. 20, 1981

[54] THALLOUS HALIDE MATERIALS FOR USE IN CRYOGENIC APPLICATIONS

[75] Inventor: William N. Lawless, 518 Illinois Ct., Westerville, Ohio 43081

[73] Assignee: William Nicholas Lawless, Westerville, Ohio

[21] Appl. No.: 41,039

[22] Filed: May 21, 1979

[51] Int. Cl.[3] ..... D02G 3/00

[52] U.S. Cl. ..... 427/120; 423/116; 423/126; 423/495; 427/117; 428/379; 428/389; 428/402

[58] Field of Search ..... 428/402, 379, 389; 427/117, 120; 174/126 S, 128 S; 62/55.5; 423/116, 126, 495; 252/70

[56] References Cited

U.S. PATENT DOCUMENTS 4,171,464 10/1979 Steyert ..... 428/379

*Primary Examiner*—Marion McCamish

*Attorney, Agent, or Firm*—Biebel, French & Nauman

[57] ABSTRACT

Thallous halides, either alone or in combination with other ceramic materials, are used in cryogenic applications such as heat exchange material for the regenerator section of a closed-cycle cryogenic refrigeration section, as stabilizing coatings for superconducting wires, and as dielectric insulating materials. The thallous halides possess unusually large specific heats at low temperatures, have large thermal conductivities, are nonmagnetic, and are nonconductors of electricity. They can be formed into a variety of shapes such as spheres, bars, rods, or the like and can be coated onto substrates.

6 Claims, 6 Drawing Figures

THALLOUS HALIDE MATERIALS FOR USE IN CRYOGENIC APPLICATIONS

BACKGROUND OF THE INVENTION

The invention described herein was made in the performance of work under NASA Contract No. 955446 and is subject to the provisions Section 305 of the National Aeronautics and Space Act of 1958 (72 Stat. 435; 42 USC 2457).

This invention relates to nonmagnetic, dielectric compositions of matter which have large specific heats at low temperatures and their use in low-temperature, cryogenic applications.

The development and use of low temperature processes has greatly expanded in recent years. The space program has spurred action in liquefaction of many different gases including nitrogen, oxygen, helium, and hydrogen. Additionally, the liquefaction of natural gas for large-scale ship transport has been greatly increased as demands for energy in this country have grown.

In many cryogenic applications, the materials used must have large specific heats at the low operating temperatures encountered. For example, the solid packing material used as a heat exchange medium in the regenerator section of closed-cycle stirling-type refrigerators must not only be mechanically stable, but also must have a high specific heat at low temperatures to match closely the specific heat of the refrigerant being utilized for maximum operating efficiency. This is particularly true when helium gas is the refrigerant because at temperatures below 20° K., its specific heat becomes very large. A specific heat mismatch between the solid packing material and refrigerant results in a loss of efficiency.

Other cryogenic applications also require materials with a large low-temperature specific heat. The specific heats of all of the materials used as superconducting wires are quite small at low temperatures. Therefore, the application of a coating of a material with a large specific heat at low temperatures will result in improved thermal stability of the superconductor. Still other cryogenic applications may require materials with special combinations of properties. These properties include a large thermal conductivity at low temperatures, mechanical stability, resistance to cyclic fatigue or cryogenic embrittlement, a nonmagnetic nature, and a nonconductor of electricity.

A large number of prior art materials have one or more of the above properties. These include lead (Pb) which is nonmagnetic and has a large low-temperature specific heat and neodymiun (Nd), europium selenide (EuSe), and alloys of erbium, gadolinium, and rhodium (Er-Gd-Rh). However, all of these materials are electrical conductors; in fact, lead is a superconductor at low temperatures.

Even though lead is the most widely used material, it suffers from several shortcomings. It is a relatively soft material with poor creep and impact fatigue properties. In use in the regenerator section of cryogenic cooling systems it tends to degrade into a powder because of cyclic fatigue, and cryogenic embrittlement. Even when hardened by the addition of small amounts (up to 4%) of antimony and made into small spheres, longitudinal thermal conductance between spheres and the breakdown of the spheres into powder shortens the useful life of lead as a heat exchange material in a cryogenic regenerator.

Thus, although some of the materials used by the prior art have one or more of the desirable properties, to my knowledge prior to my invention there were no nonmagnetic dielectric insulating materials having large low-temperature specific heats in use in the art. Accordingly, the need exists in the art for an improved material for use in cryogenic applications which has a large low-temperature specific heat as well as mechanical stability. Additionally, there is a need for a material which combines the above properties with those of being nonmagnetic and a nonconductor of electricity which can be adapted to a wider range of utilities at cryogenic temperatures.

SUMMARY OF THE INVENTION

In accordance with the present invention, thallous halides, either alone or combined with other high specific heat ceramics such as those described in my copending application Ser. No. 29,554, filed Apr. 13, 1979, and entitled "Cryogenic Ceramic and Apparatus", can be utilized in a variety of cryogenic applications. The thallous halides are pure, singlephase, polycrystalline materials made by processes known in the art. They can easily be made 100% dense and are somewhat ductile in character.

It has been found that the thallous halides possess a combination of properties which render them admirably suitable for use as heat exchange material in the regenerator section of cryogenic refrigerating systems, as stabilizing coatings for superconducting transmission lines, and as dielectric insulating materials. The thallous halides have large heat capacities which compare favorably with those of lead at low temperatures. They have thermal conductivities of approximately half that of lead at temperatures between 7° and 15° C. and closely approach the thermal conductivity of lead below 7° K. Additionally, the thallous halides have good mechanical stability, a nonmagnetic nature, and are nonconductors of electricity. They may be used in cryogenic devices as powders, spheres, bars, or plates, or may be coated directly onto other surfaces. If formed into spheres, the spheres should have a diameter preferably of from about 0.001 to 0.015 inches.

Accordingly, it is an object of the present invention to provide a class of materials useful in low temperature applications and possessing a combination of properties not attainable in the prior art and to provide methods for using such materials in cryogenic processes. These and other objects and advantages of the invention will become apparent from the following description, the accompanying drawings, and the appended claims.

DESCRIPTION OF THE PREFERRED EMBODIMENTS

Figure 1:
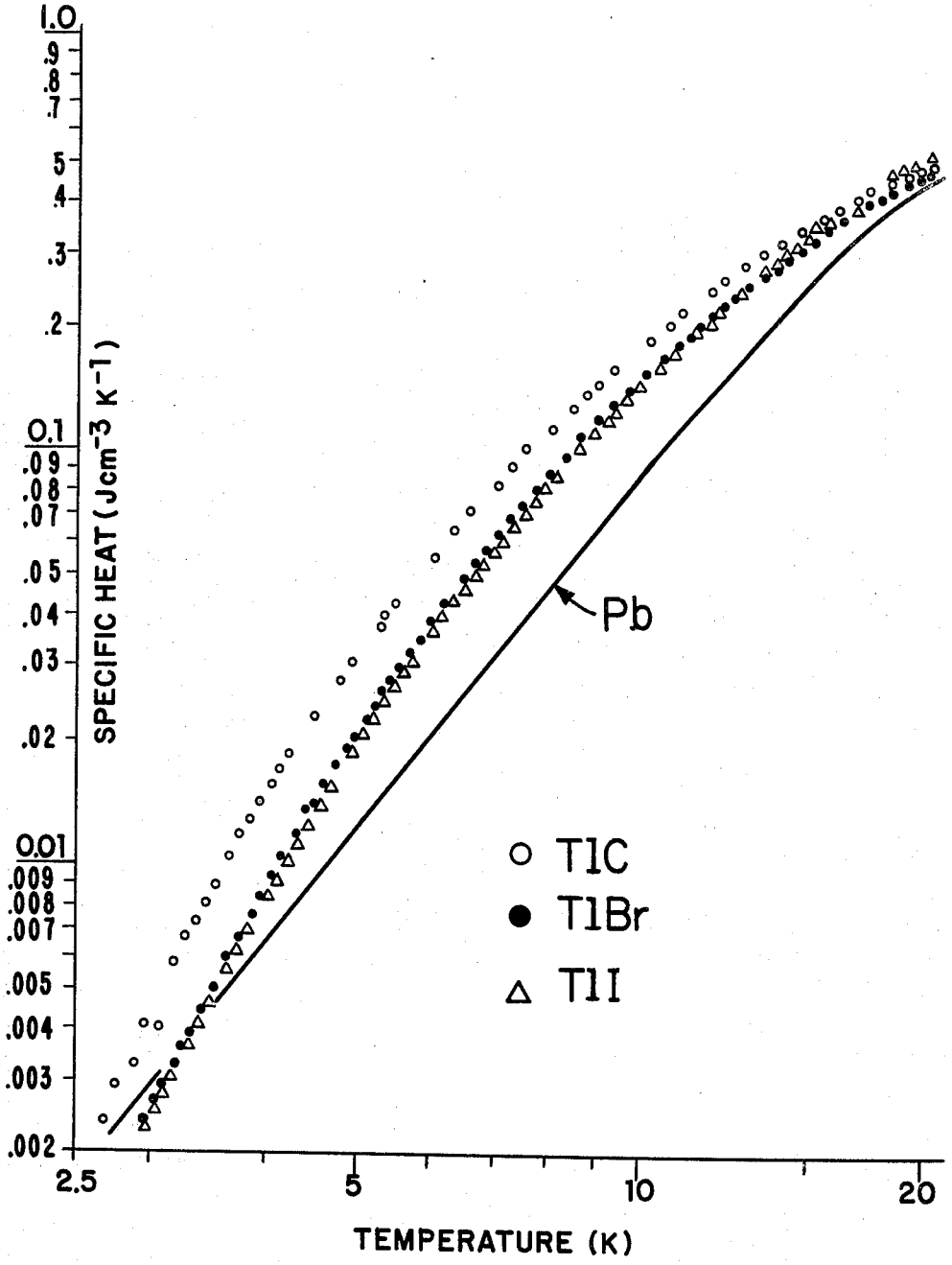
FIG. 1 is a graph of the specific heat of various thallous halides in Joules per cubic centimeter per degree Kelvin versus temperature in degrees Kelvin and includes for comparison purposes specific heat data for lead.

The thallous halides of the present invention and their methods of preparation are per se known. The thallous fluorides, chlorides, bromides, and iodides are available as crystalline materials and have melting points of from 327° C. to 430° C. Because of their ductility and flexibility, they can easily be densified and formed into spheres or other shapes utilizing standard ceramic methods. Individual thallous halide compounds or mixtures of them may be formed into structural shapes by pressing finely divided powders in a die at room temperature and then firing at sintering temperatures. Well known fugitive organic binders may be added to the powders to aid in the plastic formability of the compositions. Such organic binders are oxidized at the sintering temperatures utilized and form no part of the final structure.

Additionally, the thallous halides of the present invention may be hardened by the addition of effective amounts (i.e., less than about 10% by weight) of a valency controlled dopant material. Such dopants and their hardening effects on alkali halides are known. Examples of such dopants are silver chloride, cesium iodide, and tin chloride.

In an alterative embodiment, the thallous halides of the present invention may be mixed with the family of large low-temperature specific heat ceramic materials disclosed in my copending U.S. application Ser. No. 29,554, filed Apr. 13, 1979, and entitled "Cryogenic Ceramic and Apparatus." The ceramic materials there disclosed consist of crystalline metal oxides defined by one of the following molar formulas:

1. $AB_2O_4$, where A is selected from one or more of Group 2B metal ions alone or in combination with one or more of other divalent metal ions where at least about 90 mole % of A is a Group 2B metal ion or ions, and B is either chromium or chromium plus one or more other trivalent metal ions where at least about 90 mole % of B is chromium;

2. $AB_2O_6$, where A is selected from one or both of manganese or nickel ions alone or in combination with one or more other divalent metal ions, where at least 90 mole % of A is manganese or nickel and B is selected from one or both of niobium or tantalum ions; and 3. $A_2BCO_6$, where A is selected from lead ion alone or in combination with one or more other divalent metal ions where at least about 90 mole % of A is lead ion, B is either gadolinium or manganese alone or in combination with one or more other trivalent metal ions where at least about 90 mole % of B is gadolinium or manganese ion, and C is selected from one or both of niobium and tantalum ions.

This family of ceramics has been demonstrated to be dielectric insulators having values of specific heat at least as great as that of lead at temperatures below 15° K. These ceramics can be easily fabricated as taught in the above copending application by mixing powders of the oxides of the metals in proper molar proportions and then calcining and sintering at temperatures in the range of from 900° to 1500° C.

Referring now to FIG. 1, it can be seen that the specific heats of the thallous halides are equal to or in excess of the literature reported values for lead. The specific heats shown in the Figures are plotted on a volumetric basis which is the most demanding basis of comparison with lead because of its extremely high density. The data for lead shown in FIGS. 1 and 2 was estimated by using the following specific heat expression for metals:

$$C=C_D(\theta_D/T)+\delta T$$

where $C_D$ is the Debye function, $\theta_D$ is the Debye temperature, and $\delta$ is the coefficient of electronic contribution. Values for $\theta_D$ of 108° K and $\delta$ of $3.36\times10^{-3}$ J·mole$^{-1}$·K$^{-2}$ were taken from Gopal, Specific Heats at Low Temperatures, p.63 (Plenum Press, 1965).

Figure 2:
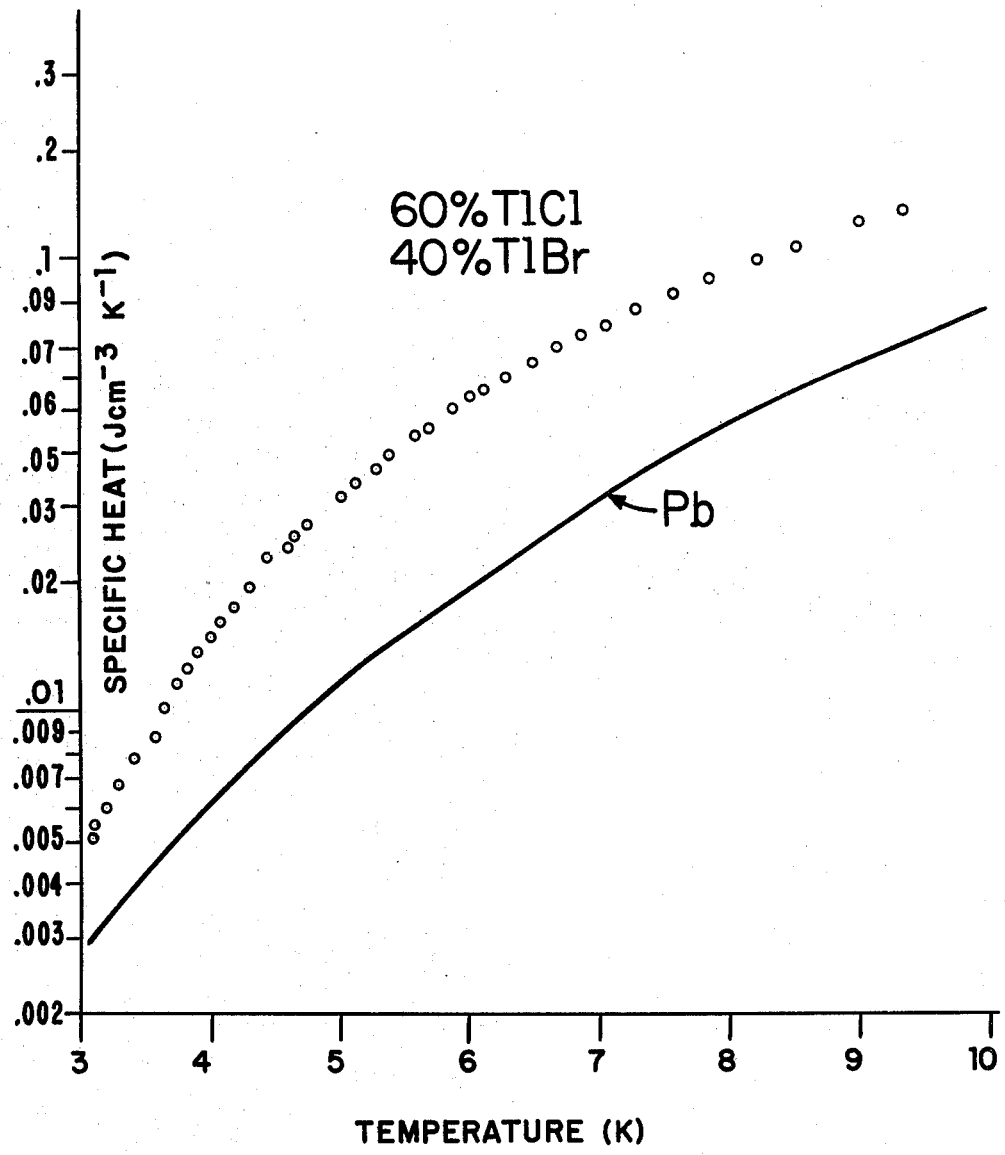
FIG. 2 is a graph of the specific heat in Joules per cubic centimeter per degree Kelvin of a mixture of 60 mole % thallous chloride and 40 mole % thallous bromide versus temperature in degrees Kelvin with specific heat data for lead included for comparison purposes.

As illustrated in FIG. 2, solid solutions of mixtures of thallous halides also possess large specific heat values. The specific heat of a solid solution of 60 mole % thallous chloride and 40 mole % thallous bromide is shown to have a specific heat in excess of that of lead and temperatures below above 10° K.

Figure 3:
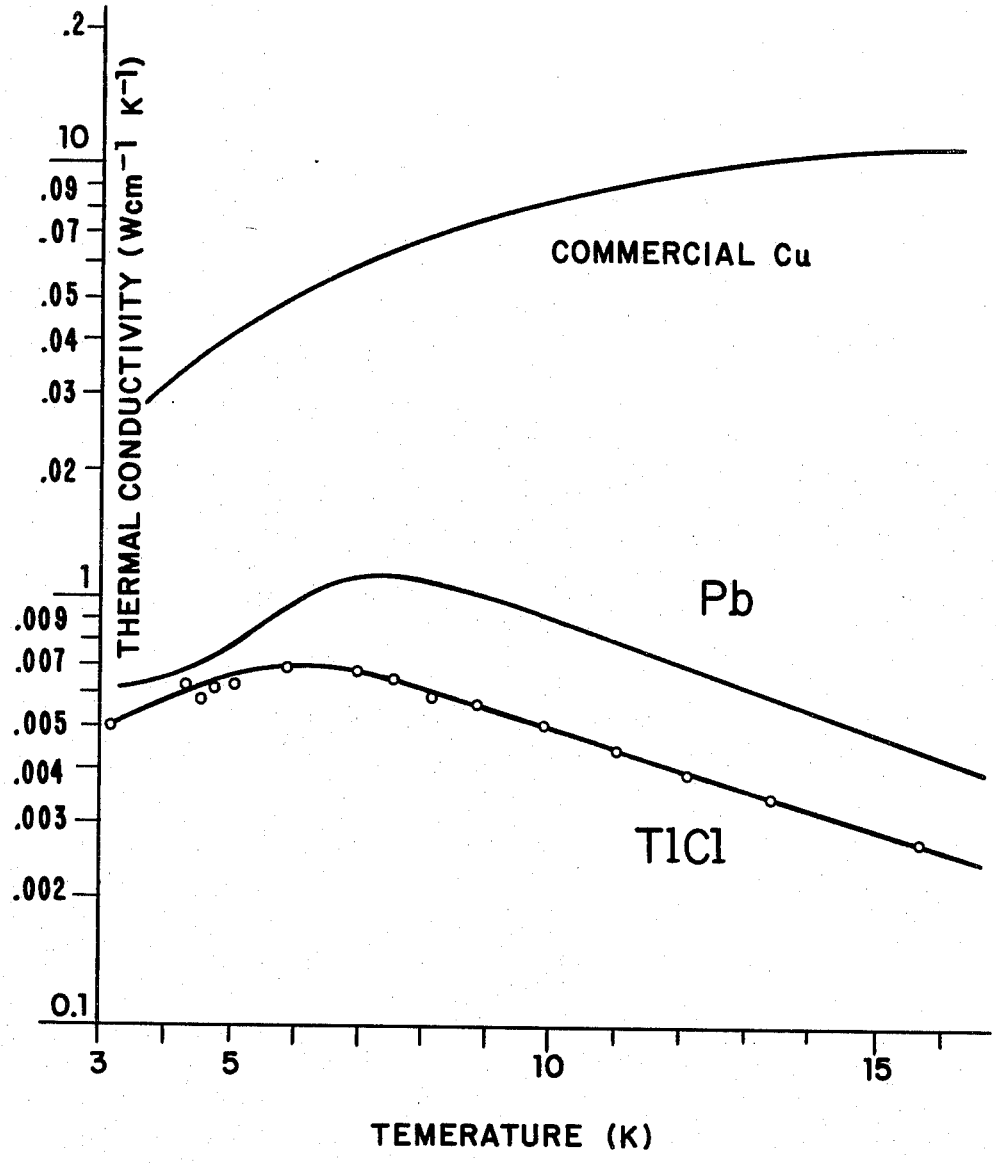
FIG. 3 is a graph of the thermal conductivity in watts per centimeter per degree Kelvin of thallous chloride versus temperature in degrees Kelvin with thermal conductivity data for lead and copper being included for comparison purposes.

The thallous halides also have high thermal conductivities at low temperatures. FIG. 3 illustrates the comparative thermal conductivities of thallous chloride, lead, and copper at temperatures below about 15° K. As can be seen, although the thermal conductivity of thallous chloride is not as large as that of lead, it is at least 50% of value for lead over the range illustrated and approaches the value for lead at temperatures below 5° K. Thermal conductivity data for both lead and copper were taken from Childs et al, NBS Monograph 131, U.S. Department of Commerce (September, 1973).

Figure 4:
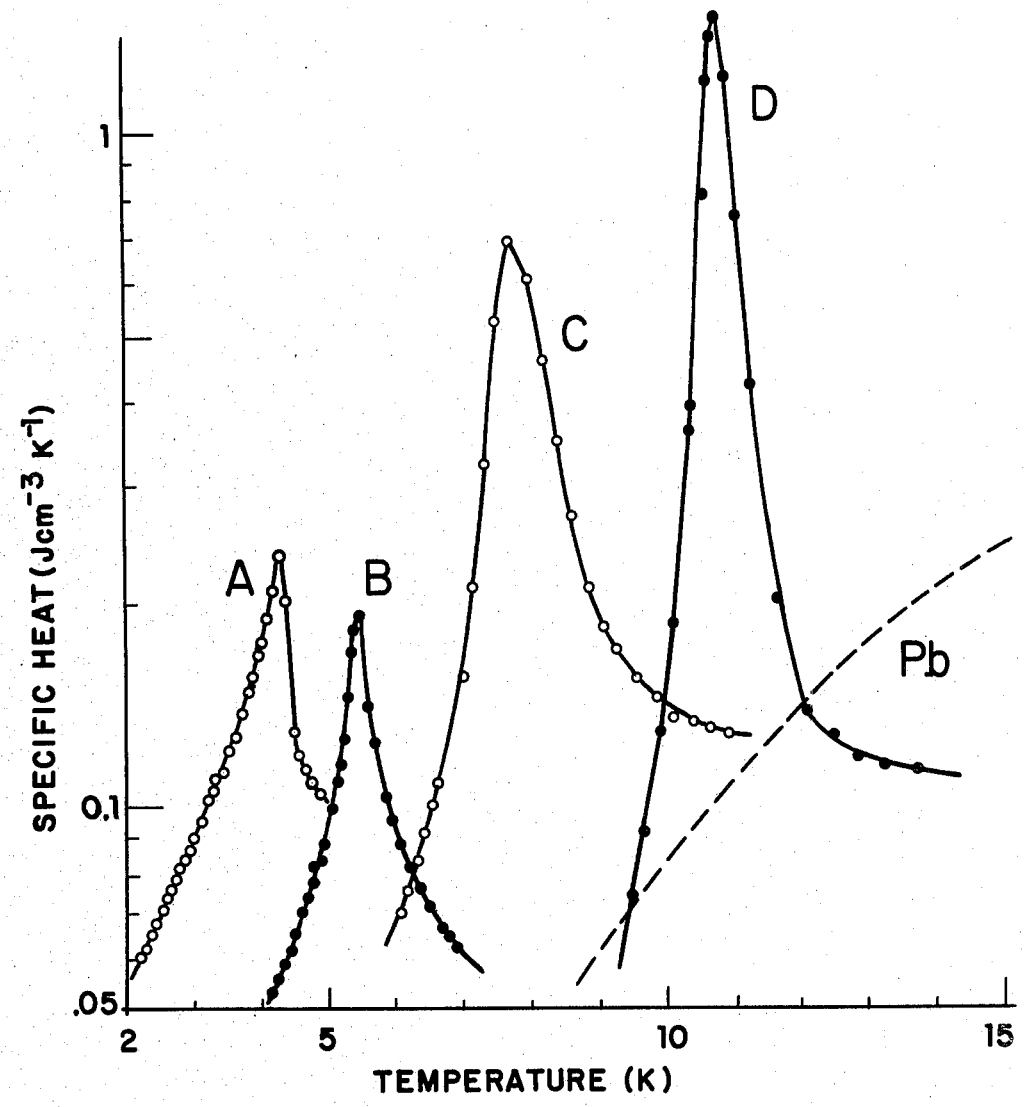
FIG. 4 is a graph of the specific heats in Joules per cubic centimeter per degree Kelvin of ceramics A-D described in my copending application Ser. No. 29,554 versus temperature in degrees Kelvin with specific heat data for lead included for comparison purposes.

Referring now to FIG. 4, the volumetric specific heats of four exemplary ceramic compositions from my above-mentioned copending application Ser. No. 29,554 are shown in comparison with that of lead. The ceramic composition labeled A is $MnNb_2O_6$, composition B is $NiNb_2O_6$, Composition C is $Cd_2Cr_3NbO_9$, and D is $Zn_2Cr_3NbO_9$. As can be seen, each individual ceramic composition has a maximum specific heat at a slightly different temperature. For example, the specific heat of ceramic C has a maximum at about 8° K of about 0.7 Joules per cubic centimeter per degree Kelvin.

Figure 5:
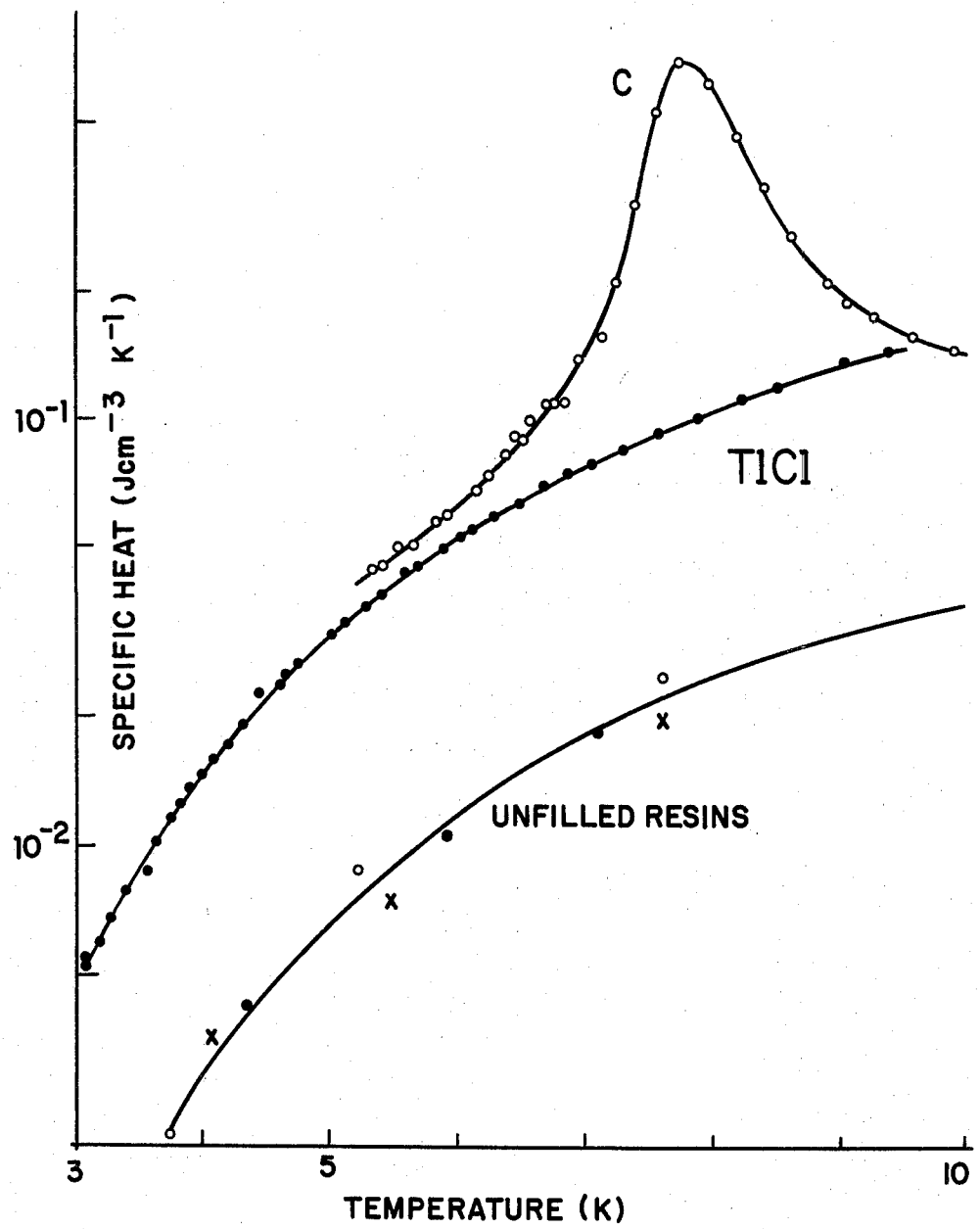
FIG. 5 is a graph of the specific heats in Joules per cubic centimeter per degree Kelvin of ceramic C and thallous chloride versus temperature in degrees Kelvin with specific heat data for epoxy resins included for comparison purposes.

As shown in FIG. 5, the volumetric specific heats of thallous chloride and ceramic C are significantly greater than those reported by Hartwig, Paper U-9, Cryogenic Engineering Conference, Queens' University, Kingston, Ontario (1975), for various unfilled epoxy resins. As illustrated in FIG. 5, the open circles signify data from an epoxy resin identified at CY221-HY979 by Hartwig; closed circles, X183/2476-HY905; and crosses, CY221-HY956. As shown, at 8° K., the specific heat of thallous chloride is 4.4 times larger than that of epoxy resins and the specific heat of ceramic C is 28 times larger on a volumetric basis.

These properties illustrate the significant advantages which are obtained by using thallous halides alone or in a composite solid solution mixture with the ceramics disclosed in my copending application Ser. No. 29,554.

This is because the windings most often utilized to insulate superconducting wires presently are epoxy resins such as Araldite epoxy resin available from General Electric Co., Schenectady, N.Y. The materials of the present invention not only having much greater specific heats at low temperatures than do the presently utilized epoxy resins, they additionally possess much greater dielectric constants, thermal conductivities, and enthalpies which will serve to provide better thermal damping of temperature fluctuations, better electrical insulation, and improved enthalpy stabilization of the superconducting wires. The thallous halide materials of the present invention can also be combined with such epoxy resins in forming insulation for superconducting wires.

The dielectric constants of the thallous halides and ceramic C are unusually large, approximately 37 for thallous chloride and approximately 300 for ceramic C. By comparison, the dielectric constants of glasses and epoxies are in the range of from 3 to 5. Moreover, the enthalpies of both the thallous halides and the ceramics disclosed in my copending application Ser. No. 29,554 are substantially greater than the presently used epoxy resins. Examplary enthalpy data relative to 4° K. for thallous chloride and ceramic C are reported in Table I below which illustrate the significant differences relative to an Araldite epoxy resin.

TABLE I

| Enthalpy Improvements Over Araldite Epoxy Resin | | |
|---|---|---|
| | Enthalpy Ratios to Epoxy | |
| Temperature (°K.) | Thallous Chloride | Ceramic C |
| 6 | 6.7 | 8.2 |
| 7 | 6.5 | 9.0 |
| 8 | 6.3 | 17.7 |
| 9 | 6.2 | 16.9 |

As can be seen, the enthalpies of thallous chloride vary from 6.2 to 6.7 times greater than that of an Araldite epoxy resin at typical operating temperatures for superconducting wires. The enthalpies of Ceramic C are even greater.

The excellent low-temperature specific heat and thermal conductivity properties of the thallous halides and the unusually high dielectric constants and enthalpies for the family of ceramic materials reported in my copending application Ser. No. 29,554 can be combined advantageously to provide a series of materials having optimum properties for operation at a given temperature. Windings for superconducting wires made of composites of the thallous halide materials and the ceramics can be made, for example, by spraying a superconducting wire with the desired composite mixed with a fugitive organic binding material which is subsequently burnt out. Alternatively, the wire may be dipped in a mixture of the composite and organic binder. In still another alternative method, the composite may be vacuum deposited on the surface of the wire using known techniques. The final thickness of the coating may be 2 to 50 times the diameter of the wire.

Figure 6:
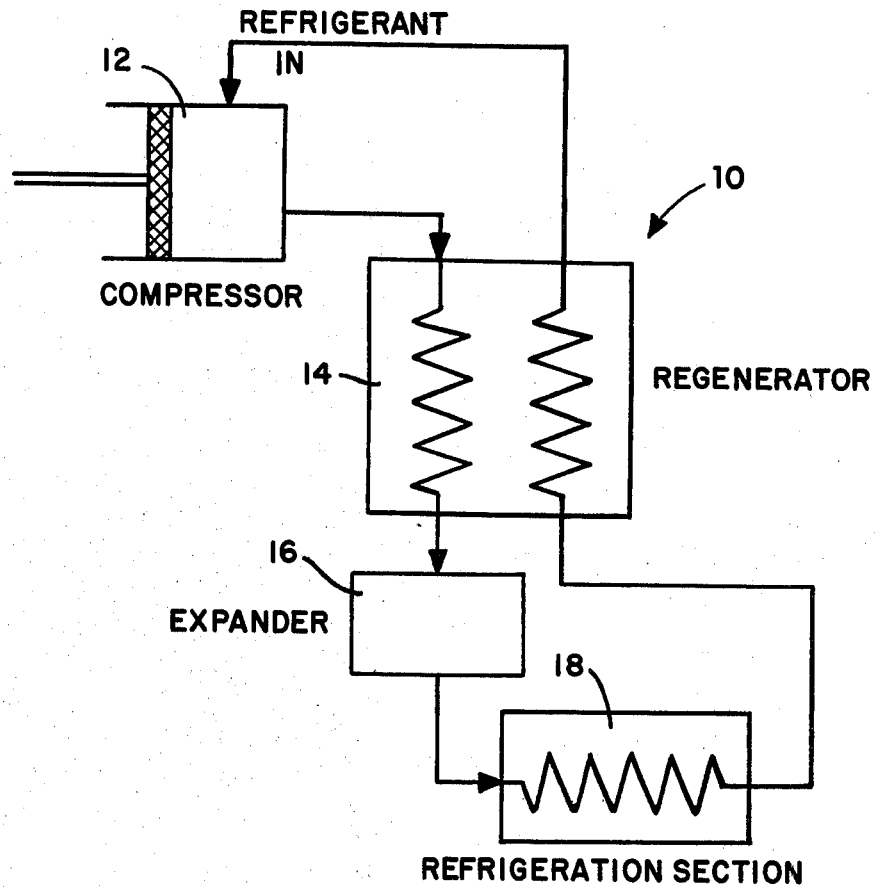
FIG. 6 is a schematic representation of a cryogenic refrigeration device, including a regenerator section.

Referring now to FIG. 6, another important utility for the thallows halide materials of the present invention is illustrated. As shown in FIG. 6, the major components of a closed-cycle cryogenic refrigeration system 10, having a compressor section 12, a regenerator section 14, an expander section 16, and a refrigeration section 18. When a refrigerant fluid undergoes compression in compressor section 12, heat energy is generated and dissipated to an adjoining heat sink (either atmosphere or previous refrigeration section). The compressed fluid refrigerant is then passed through regenerator 14 where it is cooled by giving up heat to the heat exchange material packed therein. The chilled refrigerant is then expanded while doing some work in expander section 16 and is further chilled. It is then circulated through the refrigeration section 18 where it cools a thermal load and maintains the load at a desired service temperature. The refrigerant is then passed back through regenerator 14 and cools the heat exchange material therein by taking up the heat energy stored there from the passage of the compressed refrigerant. This cycle is repeated continuously during operation.

Although lead or a lead-antimony alloy have been the most commonly used heat exchange materials in such regenerators, lead suffers from many disadvantages. Spheres of lead tend to degrade after repeated cycling at low temperatures which affects their performance. There also tends to be bonding between the spheres which increases axial thermal conductance. Moreover, when helium gas is used as the refrigerant, its large specific heat at low temperatures causes a mismatch with the specific heat of lead and prevents optimum heat exchange from occurring.

The thallous halides of the present invention have specific heats greater than lead at temperatures below 20° K. Additionally, they can be formed easily into spheres or other shapes such as bars, rods, honeycombs, or the like. When formed into spheres, they preferably have a diameter of between about 0.001 and 0.015 inches. Moreover, because they are dielectric materials, they can be used for the complete construction of the regenerator section of a closed-cycle refrigeration system. In combination with selected ceramic materials disclosed in my copending application Ser. No. 29,554, the thallous halides can provide unusually high specific heats which can be maximized for almost any desired operating temperature below 20° K.

While the compositions, methods, and apparatus herein described constitute preferred embodiments of the invention, it is to be understood that the invention is not limited to these precise embodiments, and that changes made be made in either without departing from the scope of the invention, which is defined in the appended claims.

What is claimed is:

1. A structured, ceramic, dielectric, heat exchange material for use in cryogenic applications having a specific heat equal to or greater than that of lead at temperatures below about 20° K. comprising a mixture of components X and Y, where X is selected from the group consisting of thallous fluoride, thallous chloride, thallous bromide, and thallous iodide, and where Y is selected from the group consisting of thallous fluoride; thallous chloride; thallous bromide; thallous iodide; epoxy resin; $AB_2O_4$, where A is a Group IIB metal ion with or without other divalent metal ions and B is chromium ion with or without other trivalent metal ions; $AB_2O_6$, where A is manganese or nickel ion or both, with or without other divalent metal ions and B is niobium, tantalum, or both; and $A_2BCO_6$, where A is lead ion with or without other divalent metal ions, B is gadolinium or manganese with or without other trivalent metal ions, and C is niobium, tantalum, or both, with the proviso that X and Y cannot be the same compound.

2. The structured material of claim 1 in which said mixture of components is in the form of spheres of from about 0.001 inches to about 0.015 inches in diameter.

3. The structured material of claim 1 in which said mixture of components is formed as an insulative coating for wire.

4. The structured material of claim 1 in which the thallous halide component of said mixture has been hardened by the addition of an effective amount of a valency controlled dopant.

5. A method for electrically insulating and improving the enthalpy stabilization of a superconducting metal wire comprising depositing on the surface of said wire a mixture of an organic binding agent and a structured, ceramic, dielectric, heat exchange material for use in cryogenic applications having a specific heat equal to or greater than that of lead at temperatures below about 20° K. comprising a mixture of components X and Y, where X is selected from the group consisting of thallous fluoride, thallous chloride, thallous bromide, and thallous iodide, and where Y is selected from the group consisting of thallous fluoride; thallous chloride; thallous bromide; thallous iodide; epoxy resin; $AB_2O_4$, where A is a Group IIB metal ion with or without other divalent metal ions and B is chromium ion with or without other trivalent metal ions; $AB_2O_6$, where A is manganese or nickel ion or both, with or without other divalent metal ions and B is niobium, tantalum, or both; and $A_2BCO_6$, where A is lead ion with or without other divalent metal ions, B is gadolinium or manganese with or without other trivalent metal ions, and C is niobium, tantalum, or both, with the proviso that X and Y cannot be the same compound, and then heating the mixture to oxidize said organic binding agent.

6. The method of claim 5 in which the thickness of the coating is 2 to 50 times the diameter of the wire.

* * * * *